US005773104A

United States Patent [19]

McKechnie et al.

[11] Patent Number: 5,773,104

[45] Date of Patent: Jun. 30, 1998

[54] HIGH TEMPERATURE AND HIGHLY CORROSIVE RESISTANT SAMPLE CONTAINMENT CARTRIDGE

[75] Inventors: Timothy N. McKechnie, Huntsville; Richard R. Holmes, Guntersville; Frank R. Zimmerman, Huntsville; Chris A. Power, Guntersville, all of Ala.

[73] Assignee: Plasma Processes, Inc., Huntsville, Ala.

[21] Appl. No.: 748,573

[22] Filed: Nov. 13, 1996

[51] Int. Cl.[6] ..... A47G 19/22

[52] U.S. Cl. ..... 428/34.6; 428/34.4; 432/253; 220/415

[58] Field of Search ..... 428/34.4, 34.6; 432/253; 220/415

[56] References Cited

U.S. PATENT DOCUMENTS 5,230,847 7/1993 Jalby et al. ..... 264/81

*Primary Examiner*—Christopher Raimund

*Attorney, Agent, or Firm*—Lanier Ford Shaver & Payne P.C.; Frank M. Caprio; Russell L. Sandidge

[57] ABSTRACT

A high temperature and highly corrosive resistant structure and method of fabricating the structure. In one embodiment of the present invention, vacuum plasma spray or other materials deposition techniques are used to fabricate the structure on a removable support member in the form of a gradient or composite structure that sequentially consists of a 100% ceramic interior layer, a first transition layer of ceramic/refractory metal, a layer of 100% refractory metal, a second transition layer of ceramic/refractory metal, and an outer layer of 100% ceramic material. In a second embodiment, the ceramic/refractory metal/ceramic cartridge is formed without transition layers between the ceramic and metal layers. In another embodiment of the invention the structure is fabricated on a removable support member by depositing an outer layer of ceramic material on a refractory metal. No transition layers of ceramic material/refractory metals are used. In a further embodiment of the present invention, the structure is fabricated on a removable support member by vacuum plasma spraying only a refractory metal on the removable support member which has a layer of a corrosion/oxidation preventative coating thereon which has been applied to the support member by vacuum plasma spraying or other material deposition technique.

11 Claims, 5 Drawing Sheets

HIGH TEMPERATURE AND HIGHLY CORROSIVE RESISTANT SAMPLE CONTAINMENT CARTRIDGE

STATEMENT OF GOVERNMENT RIGHTS

This invention was made with government support under contract NAS8-40000 awarded by the National Aeronautics and Space Administration. The Government has certain rights in this invention.

BACKGROUND OF THE INVENTION

1. Field of the Invention

This invention relates to a high temperature, corrosive, resistant structure and method of fabrication thereof. More particularly, this invention is directed to a specimen containment tubular housing of a cartridge assembly for use in furnaces, the cartridge assembly tubular housing is produced by plasma spray or other material deposition technologies to provide a gradient or composite structure which is corrosive resistant and operable on earth or in space at very high temperatures.

2. Description of Related Art

Sample containment cartridge assemblies usable in furnaces are known and typically contain or produce samples which must be subjected to very high furnace temperatures while being corrosive resistant to protect against sample leakage. Such assemblies typically include an outer housing in the form of a tube which encloses various components including a sample containment container.

Currently there are no single-material cartridge tubes for supporting corrosive sample materials in furnaces which satisfy the requirements for space furnaces operating between the temperature ranges of 1200° C. (2300° F.) to 2000° C. (3632° F.). In addition, the fabrication of current cartridge tubes has been complicated and expensive, requiring numerous steps & different fabrication processes. Sample containment cartridges are often machined or drawn, then the ends are welded on and finally the cartridge is coated. Inconel 718 has been used for previous experiments operating at 1150° C. (2102° F.). To provide containment for experiments above 1200° C., a variety of refractory metals (i.e., Re, W, Ta, Mo, and alloys Nb-TiHf, Mo-40%Re, W-25%Re, W-Ni), and mixtures thereof were considered to be usable. The term "refractory metals" as used herein refers to metals having a melting point above 1200° C. While these metals provide adequate strength at these high temperatures, they tend to be less able to withstand high temperature oxidation or liquid metal corrosion should sample containment (quartz) rupture or leak molten semiconductor materials (i.e., GaAs, Ge, etc.). A variety of ceramic materials (BN, SiC, $Al_2O_3$, $Si_3N_4$, $SiO_2$, $ZrO_2$) and mixtures thereof are impervious to the aggressive attack of the molten semiconductors and provide a high service temperature. However, the ceramics are too brittle to be fabricated (high thermal gradients induce stress) and handled in very thin sections as required for some applications, such as cartridge tubes which are operable in space.

Vacuum plasma spray ("VPS") techniques are utilized in the preferred embodiment of the present invention for the formation of a ceramic and refractory metal composite structure unachievable by conventional methods. Likewise, vacuum plasma spray techniques are utilized for the formation of a refractory metal tubular member suitable for such cartridge tubes. For fabricating the composite structure, it is of interest to utilize the desirable properties of both materials while compensating for their weak points. The ceramics' high temperature capabilities and corrosion/oxidation resistance combined with the refractory metals' ductility and toughness leads to a very robust cartridge tube for high temperature containment.

SUMMARY OF THE INVENTION

The present invention improves over the prior art by achieving a corrosive-sample containment cartridge able to withstand a broad temperature range, including temperatures above 1200° C. (2300° F.), substantially net-shape (with little or no machining required), in one operation by employing a material deposition technique, such as vacuum plasma spraying. In one embodiment of the present invention, the cartridge tube is fabricated in the form of a gradient or composite structure that consists of 100% ceramic interior surface, a ceramic/refractory metal gradient transition, 100% refractory metal, another gradient transition layer of ceramic/refractory, completed by a 100% ceramic layer forming the tube exterior surface. In addition, very specialized robotic manipulation of the workpiece and the VPS gun allows this article to be fabricated all in one operation. A removable graphite mandrel is used in order to allow this net-shape fabrication to occur. After the net-shape VPS run is completed the cartridge tube is easily removed due to the difference in thermal expansion of the graphite as compared to the cartridge tube materials.

In another embodiment of the invention, the cartridge tube is fabricated using an outer layer of ceramic material on a deposited refractory metal. No transition layers of ceramics and refractory metals are used in this embodiment. In a further embodiment of the present invention, the cartridge tube is fabricated using only a refractory metal having a corrosion/oxidation preventative coating applied on the tubular member and on the deposited metal layer by vacuum plasma spraying or by other coating technique. The corrosion/oxidation preventative coating may be aluminum oxide or other such corrosion/oxidation preventative materials (suicides) applied to either the inner or outer surface or both surfaces of the tube. Or, if desired, the oxidation preventative coating may be diverse coatings of corrosion/oxidation preventative materials on the inner and outer surface of the refractory metal.

Recent advancements in material deposition technologies have enabled substantially net-shape fabrication (little machining) of metallic and/or metallic-ceramic composite parts. One deposition process, VPS, works by injection of metal or ceramic powder into a plasma flame created by the ionization of gases by a DC arc. This flame substantially softens and makes the material substantially semi-molten and accelerates the substantially semi-molten material onto a support or substrate. The term "vacuum plasma spraying" or VPS as used herein refers to such a process. Further, the development of leachable or removable mandrels has greatly enhanced the ability to fabricate articles to net-shape with VPS.

While the preferred embodiments of the present invention utilize a VPS deposition technique, it will be obvious to those skilled in the art that other material deposition techniques may work equally well and are envisioned within the scope of the present invention. Some examples of other material deposition techniques envisioned are thermal spray, vapor deposition, plating and electroplating. These techniques are listed as examples and should not be construed to exclude other material deposition techniques.

DESCRIPTION OF THE PREFERRED EMBODIMENTS

Figure 1:
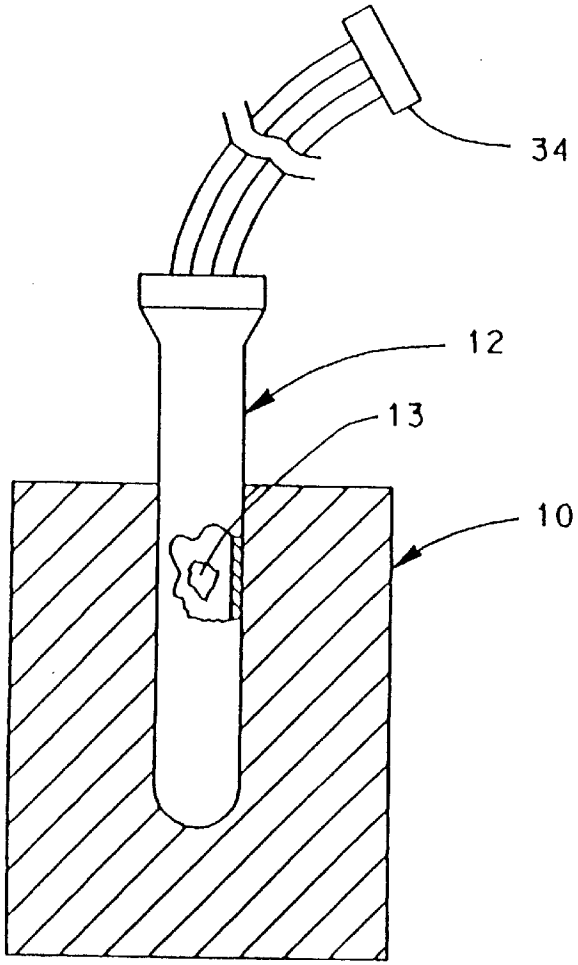
FIG. 1 is a diagrammatic sectional view illustrating a furnace having the sample containing cartridge including a cartridge outer housing or tube of the present invention positioned therein.

As seen in FIG. 1, a furnace 10 is shown to have a cartridge tube assembly 12 therein. The cartridge tube encloses a specimen 13 for heating thereof. The furnace 10 is disposed for heating the cartridge and specimen sample therein to extremely high temperatures.

Figure 2:
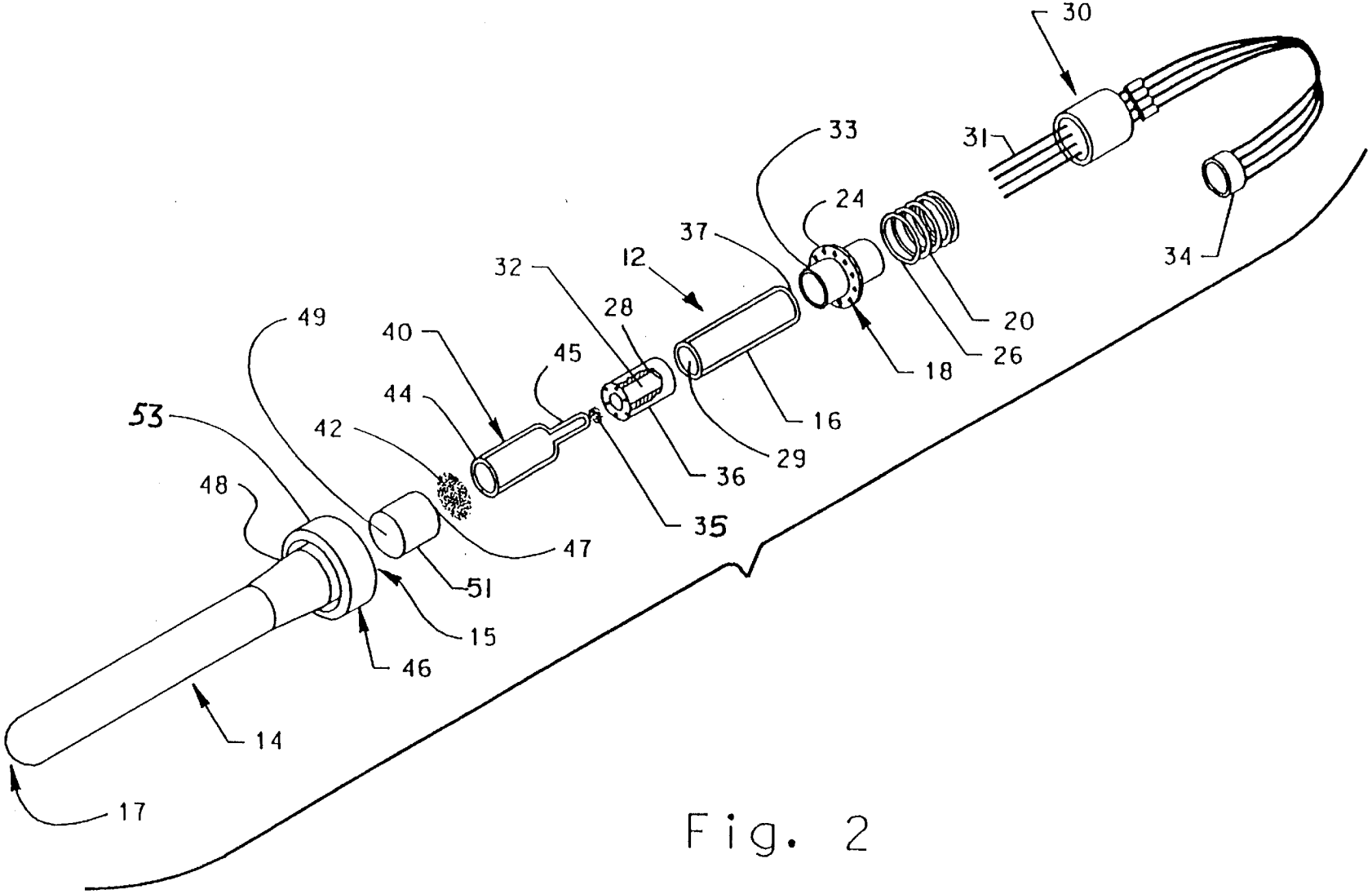
FIG. 2 is an exploded view of the cartridge assembly of FIG. 1 including an ampoule for enclosing a sample under study.

FIG. 2 is an exploded view of a cartridge tube assembly 12 for enclosing the sample. As seen in FIG. 2, the cartridge tube assembly 12 is shown to include a cartridge tube 14 having an open end 15 and a closed end 17, a quartz spacer tube 16 having open ends 29 and 37, a spring retainer 18 and a spring 20 having one end 26 adapted for abutting a flange 24 of the spring retainer 18. A thermocouple/end cap assembly 30 is provided for attachment to the open end 15 of cartridge tube 14. End cap assembly 30 is provided with a connector 34 which is connected to thermocouple elements 31 of thermocouple/end cap assembly 30. Quartz spacer tube 16 fits portion 33 of spring retainer 18. An upper ampoule support 36 is adapted to abut open end 29 of quartz spacer tube 16 and is provided with a passage 32 having a closed end 28. A quartz ampoule 40 is provided for containment of the specimen therein. Quartz ampoule 40 includes an extending end portion 45 which is supported in passage 32 of upper ampoule support 36. A quartz wool element 35 is provided adjacent extending end portion 45 of quartz ampoule 40. Quartz ampoule 40 further includes an open end 44 which is sealed after receiving the specimen. A quartz wool member 42 is provided adjacent open end 44 of quartz ampoule 40. A boron nitride spacer 51 having ends 47 and 49 positions quartz ampoule 40 in the exact spot for furnace translation and proper specimen melting/recrystallization. An adjustment block assembly 46 is provided at an end 48 of cartridge tube 14 for containing the above described members therein responsive to secured relation of end cap assembly 30 with a flanged portion 53 of adjustment block assembly 46.

Figure 3:
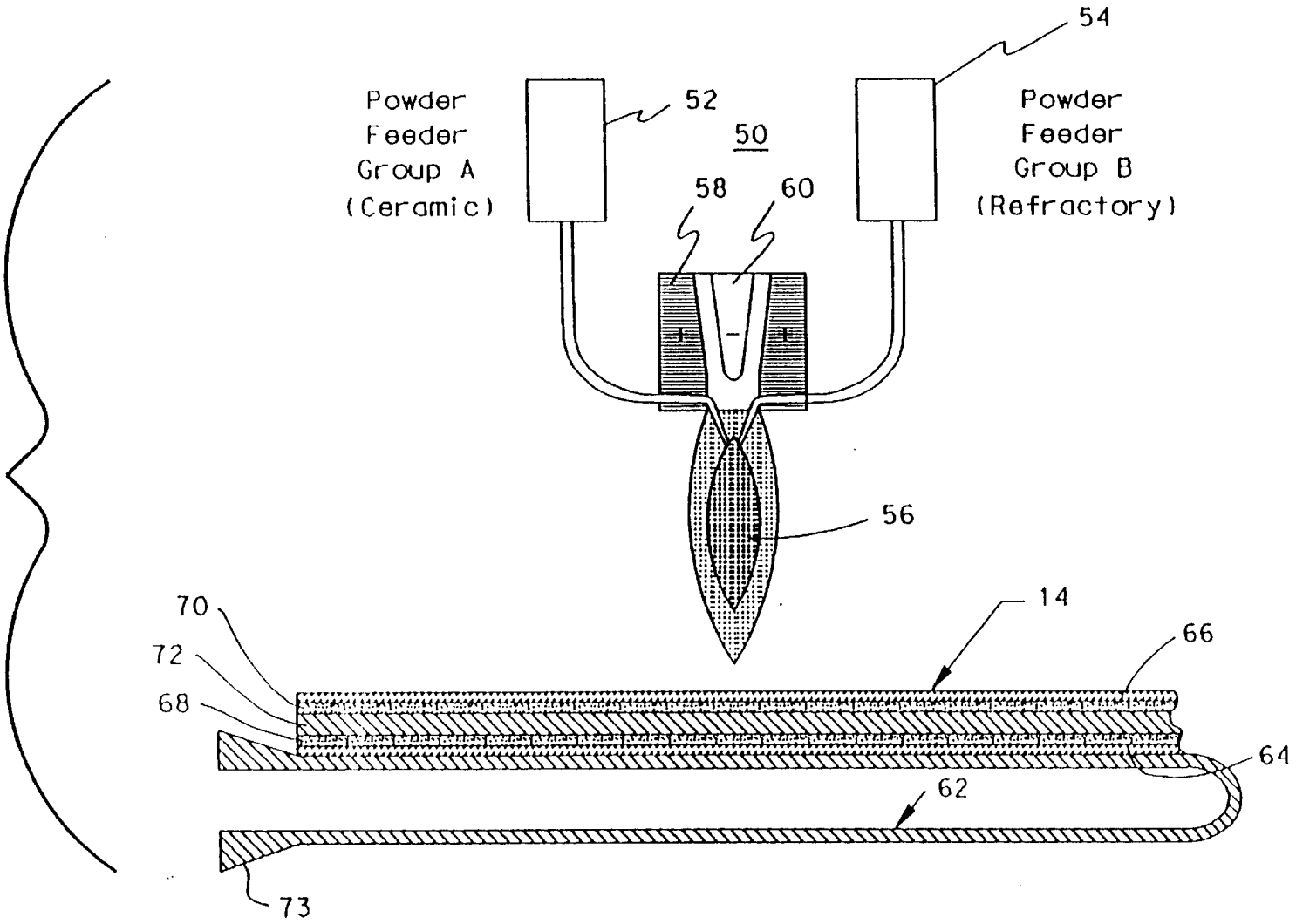
FIG. 3 is a diagrammatic view diagrammatically illustrating the method used for the application of a refractory/ceramic coating on a mandrel.

The above described sample containment cartridge tube 14 is manufactured, in accordance to the principles of the present invention, by the process illustrated in FIG. 3 wherein a vacuum plasma spray apparatus 50 is used to spray powders identified as "Group A" powders (ceramic) and "Group B" powders (refractory metal) from feeders 52 and 54, respectively, into a plasma jet 56 produced by electrodes 58 and 60. The plasma jet 56 heats the powders and deposits the heated material in a predetermined sequence onto a removable graphite mandrel 62. The powders indicated as "Group A" are any one or combination of ceramic powders chosen from SiC, $SiO_2$, $ZrO_2$, $Si_3N_4$, BN, Ir, and $Al_2O_3$. The powders indicated as "Group B" are refractory metals such as Re, Ta, Mo, W, Pt, and alloys which include Mo-40%Re, W-25%Re, W-Ni and Nb-TiHf (WC-103). The inner and outer layers 64 and 66, respectively, of cartridge tube 14 comprise a layer of ceramic material and are any one or combination of powders chosen from "Group A". The next adjacent inner and outer layers 68 and 70 are formed of a gradient comprised of a mixture of powders chosen from Groups A and B, while the central layer 72 is formed of a refractory metal or combination of refractory metals chosen from "Group B".

For the specific embodiment of the tubular housing discussed herein, the thickness of the inner and outer layers 64 and 66 is approximately 0.002" thick. The thickness of the next adjacent layers 68 and 70 is approximately 0.0015" thick, and the central layer 72 of refractory metal is approximately 0.020" thick. While the above dimensions are applicable to the cartridge tube 14, it is to be understood that other thicknesses may be resorted to for other specific purposes but are within the inventive concept of the present invention. FIG. 3 also illustrates a VPS build-up or enlarged portion 73 on the open end of cartridge tube 14 for the adjustment block assembly 46 to fit snugly against when the end cap assembly 30 engages flanged portion 53 for secured relation to cartridge tube 14.

Figure 4:
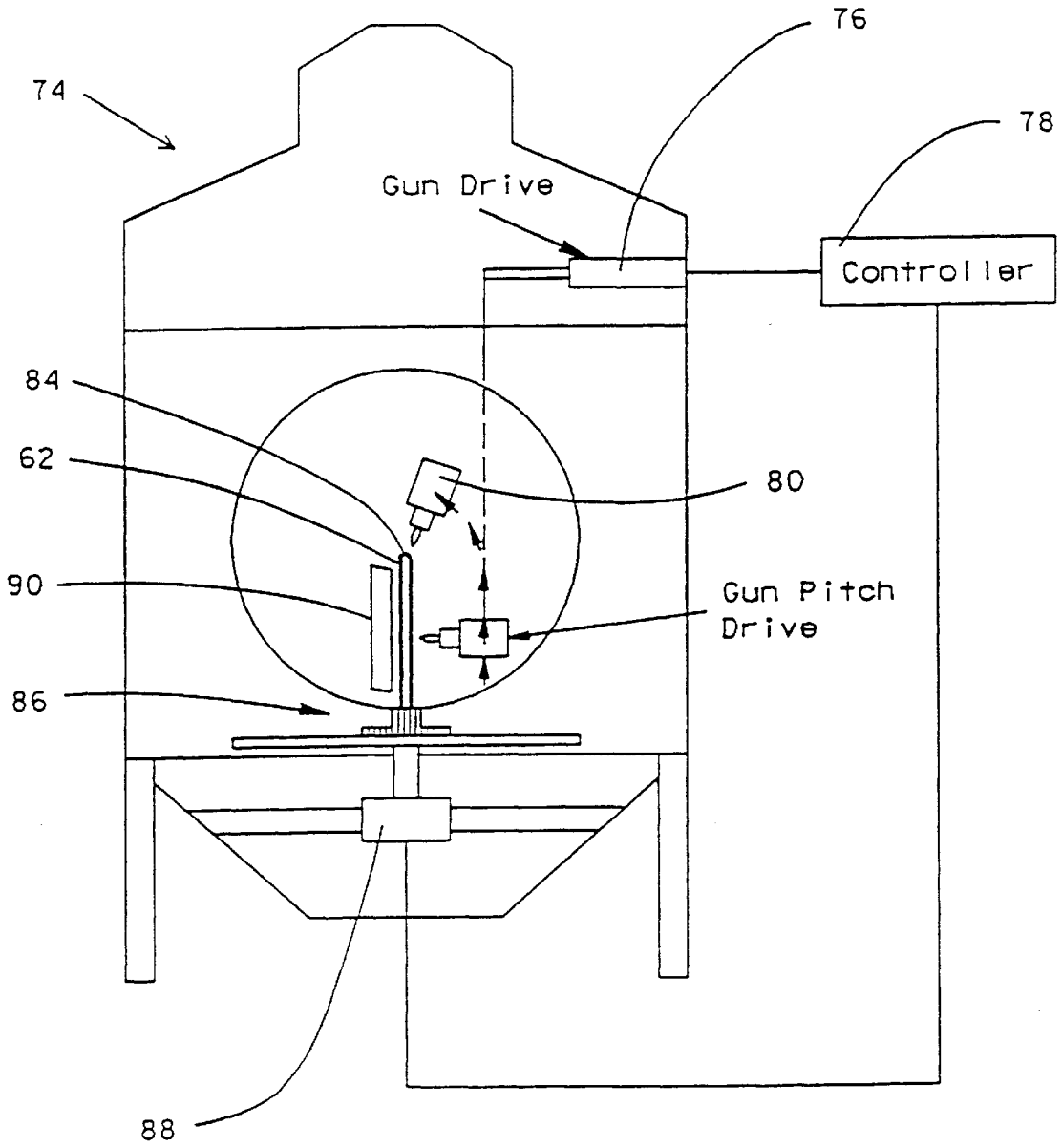
FIG. 4 is a diagrammatic elevational view of the vacuum spray apparatus used in the fabrication of the furnace cartridge of the present invention.

FIG. 4 is an elevational view of the vacuum plasma spray apparatus 74 for depositing the layers of ceramic and refractory materials on the mandrel. The vacuum plasma spray apparatus 74 may include a computerized motion controller which is well known in the art. As seen in FIG. 4, the vacuum plasma spray apparatus 74 is diagrammatically shown to include a gun drive device 76 connected to a controller 78, such as the computerized motion controller which moves a gun 80 in a path substantially normal to the surface of removable graphite mandrel 62. The programmer moves the gun in a path along the mandrel length and over the top 84 of the mandrel while maintaining substantially a 90° orientation of the gun relative to the mandrel. A mounting fixture 86 secures the mandrel in the apparatus and a turntable 88 is provided for rotating the mounting fixture 86 at a predetermined rate of rotation so as to provide even layers of the deposited material. A reflector 90 may be provided adjacent the mandrel.

Figure 5:
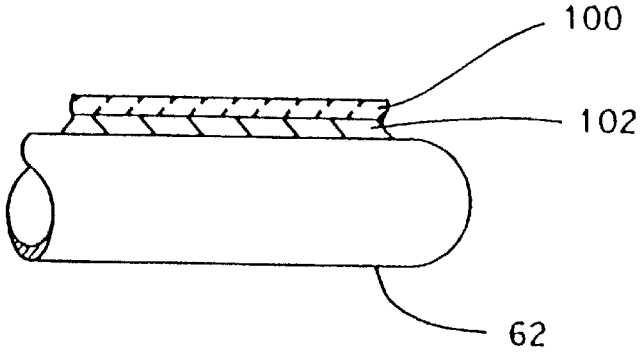
FIG. 5 is a sectional view of another embodiment of the cartridge tube of the present invention wherein only 100% ceramic and 100% refractory metal layers are used. No transition layers of ceramic and refractory metals are used in this embodiment.

Another embodiment of the cartridge tube 14 is illustrated in FIG. 5 wherein like numerals refer to like parts. As seen in FIG. 5, only ceramic ($Al_2O_3$, for example) 100 and refractory 102 layers are used to produce the cartridge tube. The vacuum spray apparatus of FIGS. 3 and 4 is used as described to spray an inner layer 102 of refractory metal and an outer layer 100 of ceramic material. The ceramic material may be comprised of any one of or combinations of SiC, $SiO_2$, $ZrO_2$, $Si_3N_4$, BN, Ir, and $Al_2O_3$. The refractory metal used in this embodiment excludes those which are attacked by corrosive materials and may be comprised of any one of or combinations of Re, Ta, Mo, W, Pt, and alloys such as Mo-40% Re, W-25% Re, W-Ni and Nb-TiHf. No transition layers are provided in this embodiment.

Figure 6:
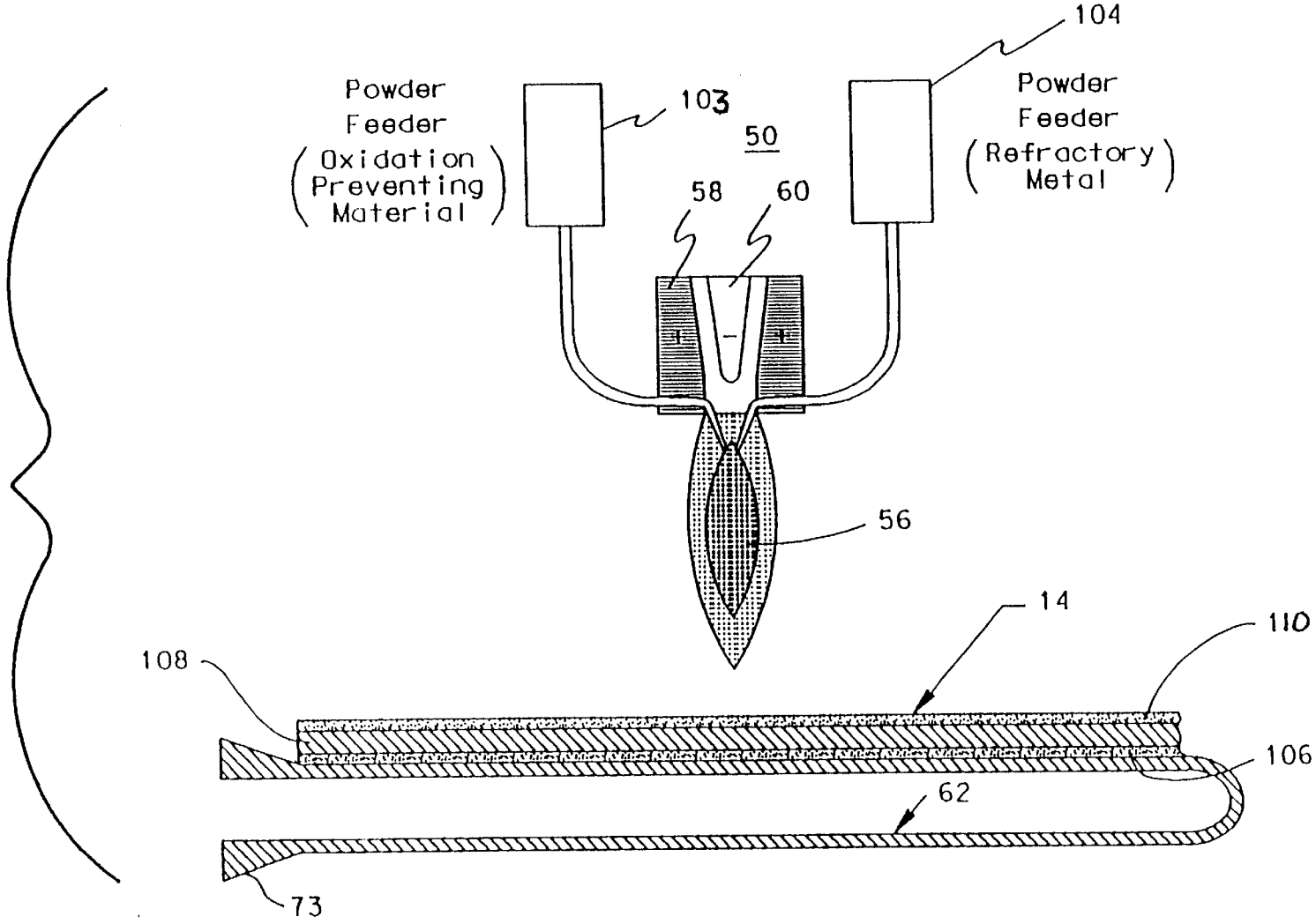
FIG. 6 is a view similar to FIG. 3 illustrating an embodiment of the present invention wherein a surface protectant material is shown applied on the surface of the mandrel. A 100% metallic layer is deposited on top of the surface protectant material and then over coated with oxygen protective coating. No transitional layers are used in this embodiment.

FIG. 6 is a view similar to FIG. 3 and illustrates the vacuum plasma spray apparatus 50 as including a hopper 103 having an oxidation preventing ceramic material therein. The second hopper 104 carries a refractory metal therein for deposition on mandrel 62. A first protective ceramic coating 106 is first deposited on the mandrel, and then a refractory metal layer 108 is vacuum plasma sprayed on the mandrel (a wall thickness of approximately 0.0021" was provided on the mandrel for this particular embodiment, however, other thicknesses may be resorted to, if desired). Then, a second protective ceramic coating 110 of material (such as aluminum oxide) is vacuum plasma sprayed on the refractory metal layer 108 to provide protection against oxidation and corrosion. Refractory metals preferably used in this embodiment are W and Mo-40% Re.

As discussed herein, a material deposition technique, such as VPS, is used to fabricate furnace cartridge tubes out of refractory metals and ceramics for use at temperatures above 1200° C. in potentially hazardous liquid metal environments if sample containment leaked. Cartridges are fabricated by introducing powder into a plasma jet where it is accelerated toward the mandrel in a semi-molten state (softened) where it is deposited to high densities. VPS parameters for depositing refractory metals and ceramics synergistically are developed to achieve this microstructural milestone. The mandrel may be made of graphite to allow the cartridge tube to be slipped off after completion of the vacuum plasma spray procedure.

Unique robotic manipulation of the VPS gun and the graphite mandrel also allows the fabrication to be completed in one operation. The VPS gun is maintained at substantially a 90° angle to the mandrel surface at all times since this provides the highest densities. The computerized motion controller is programmed to achieve this particular orientation of the gun. The overall required thickness (typically 0.027" for the manufacture of cartridge tube 14 as disclosed herein) is completed and then the gun is relocated at the bottom of the tube where an adjustment block (thick flange) is built up, if required. The mandrel is preheated using the gun prior to introducing powder into the plasma jet. The heat loss from the mandrel can be minimized by the use of a metal reflector which serves to reflect the heat back onto the mandrel.

Although only a single powder container (hopper) for the ceramic materials and a single powder container (hopper) for the refractory metals is illustrated in FIG. 3, this is for illustrative purposes only and it is to be understood that a plurality of powder containers may be relied upon whereby each powder container may contain discrete ceramic materials and discrete metals chosen from the above identified groups of ceramic materials and refractory metals.

It is to be understood that while the formed element (tube) as set forth herein has been described as being used in environments of at least 1200° C., the elements may be advantageously used at lower temperatures, particularly when the sample includes corrosive materials such as Cadmium-Zinc-Telluride or Mercury-Cadmium-Telluride.

It is to be further understood that gradients or transitional layers of refractory metals and ceramics are used when the Coefficients of Thermal Expansion between these materials are significant.

The invention claimed is:

1. A sample containment cartridge capable of being subjected to temperatures above 1200° C., comprising:

a housing having an open end and a closed end, said housing being highly corrosive resistant and capable of withstanding high temperatures;

a discrete sample container carried in spring biased relation within said housing to provide shock resistant support of said sample in said housing;

an end cap disposed for secured relation on said open end of said housing to form an enclosed housing;

said housing comprised of a refractory metal selected from the group consisting of Re, Ta, W, Mo, Pt, Nb and alloys including Mo-40% Re, W-25%, Re, W-Ni and Nb-TiHf (WC103) and mixtures thereof, said refractory metal having an inner and outer surface; and an inner layer of ceramic material adhered to said inner surface of said refractory metal, said inner layer of ceramic material having an inner and outer surface.

2. A sample containment cartridge as in claim 1 wherein said ceramic material is selected from the group consisting of BN, Ir, SiC, $Al_2O_3$, $SiO_2$, and $ZrO_2$ and mixtures thereof.

3. A sample containment cartridge as in claim 2 including a first transitional layer of a mixture of ceramic material and refractory metal disposed between said ceramic layer and said refractory metal and in adhered relation with said outer surface of said ceramic material and said inner surface of said refractory metal layer.

4. A sample containment cartridge as in claim 3 including a second transition layer of a mixture of said ceramic materials and refractory metals disposed in adhered relation on said outer surface of said refractory metal, said second transition layer having an inner and outer surface.

5. A sample containment cartridge as in claim 4 including a second layer of ceramic material disposed in adhered relation with said outer surface of said second transition layer.

6. A sample containment cartridge as in claim 1 including an inner layer of oxidation/corrosive preventing material provided on said inner surface of said refractory metal.

7. A sample containment cartridge as set forth in claim 6 including an outer layer of oxidation/corrosive preventing material provided on said outer surface of said refractory metal.

8. A sample containment cartridge as set forth in claim 7 wherein said inner and outer layers of oxidation/corrosive preventative material are of diverse oxidation/corrosive preventing materials.

9. A sample containment cartridge as in claim 3 wherein said ceramic material used in said first transitional layer is selected from the group consisting of BN, Ir, SiC, $Al_2O_3$, $SiO_2$, $ZrO_2$, and mixtures thereof, and said refractory metal in said first transitional layer is selected from the group consisting of Re, Ta, Mo, W, Pt, and alloys including Mo-40%, Re, W-25% Re and Nb-Hf, and mixtures thereof.

10. A sample containment cartridge as in claim 4 wherein said ceramic material in said second transitional layer is selected from the group consisting of BN, Ir, SiC, $Al_2O_3$, $SiO_2$, $ZrO_2$, and mixtures thereof, and said refractory metal in said second transitional layer is selected from the group consisting of Re, Ta, Mo, W, Pt, and alloys including Mo-40%, Re, W-25% Re and Nb-Hf, and mixtures thereof.

11. A sample containment cartridge as in claim 5 wherein said second layer of ceramic material is selected from the group consisting of BN, Ir, SiC, $Al_2O_3$, $SiO_2$, and $ZrO_2$ and mixtures thereof.

* * * * *

UNITED STATES PATENT AND TRADEMARK OFFICE

CERTIFICATE OF CORRECTION

PATENT NO. : 5,773,104

DATED : June 30, 1998

INVENTOR(S) : Timothy N. McKechnie, Richard R. Holmes, Frank R. Zimmerman, and Chris A. Power It is certified that error appears in the above-identified patent and that said Letters Patent is hereby corrected as shown below:

Col. 2, line 37
replace "(suicides)"
with --(silicides)--.

Signed and Sealed this

Eighth Day of September, 1998

*Attest:*

Bruce Lehman

BRUCE LEHMAN

*Attesting Officer*

*Commissioner of Patents and Trademarks*